United States Patent [19]

Josuttis et al.

[11] Patent Number: 4,572,216

[45] Date of Patent: Feb. 25, 1986

[54] APPARATUS FOR FILLING CIGARETTE PAPERS WITH TOBACCO

[75] Inventors: Horst Josuttis; Ralf Meierkord, both of Espelkamp; Hans-Jürgen Welsch, Mannheim, all of Fed. Rep. of Germany

[73] Assignee: Harting Elektronik GmbH, Espelkamp, Fed. Rep. of Germany

[21] Appl. No.: 564,625

[22] Filed: Dec. 22, 1983

[30] Foreign Application Priority Data

Dec. 22, 1982 [DE] Fed. Rep. of Germany ..... 3247370

[51] Int. Cl.[4] ..... A24F 5/42

[52] U.S. Cl. ..... 131/70; 131/74; 131/75

[58] Field of Search ..... 131/70–76

[56] References Cited

FOREIGN PATENT DOCUMENTS 0385540 12/1923 Fed. Rep. of Germany ..... 131/70
0196635 3/1938 Switzerland ..... 131/70

*Primary Examiner*—Vincent Millin
*Attorney, Agent, or Firm*—Jordan and Hamburg

[57] ABSTRACT

Apparatus for manufacturing cigarettes includes a tobacco hopper having a lower aperture, a dispensing device receiving tobacco from the aperture and dispensing the tobacco, a tobacco supply chamber disposed below the hopper to receive tobacco from the dispensing device, conveyor spindle means in the tobacco supply chamber for forming tobacco into a strand, an outlet on the tobacco supply chamber for the lateral discharge of the strand of tobacco, and a cigarette paper shell filling tube disposed adjacent to the outlet to receive therefrom the strand of tobacco to thereby form a cigarette.

15 Claims, 16 Drawing Figures

Fig.11
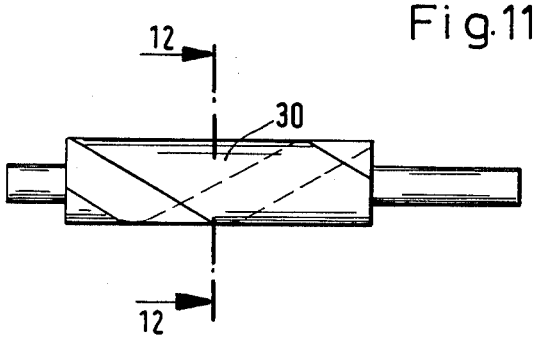
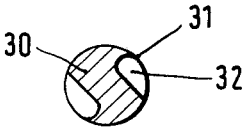
Fig.12
Fig.13
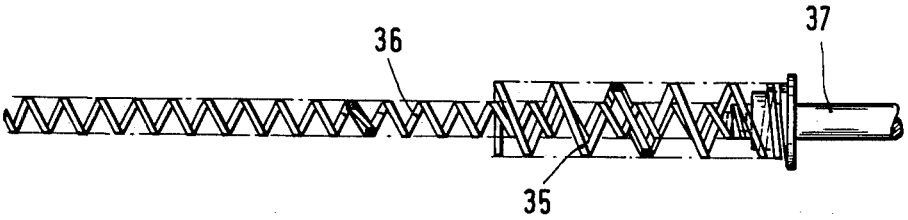

Fig.14
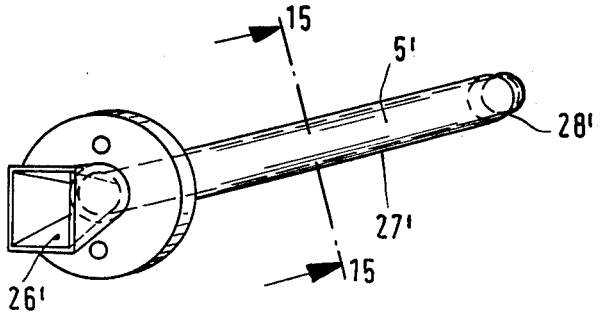
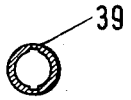
Fig.15
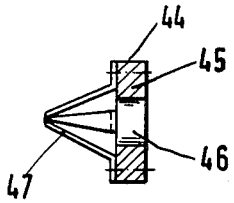
Fig.16

APPARATUS FOR FILLING CIGARETTE PAPERS WITH TOBACCO

BACKGROUND OF THE INVENTION

This invention relates to an apparatus for filling prepared cigarette papers, preferably filter-cigarette paper shells, with cigarette tobacco.

With this type of apparatus it is necessary to form a skein or strand from a fine-fibered tobacco supply and insert this into the cigarette paper shell. The bulk tobacco which is initially in a continuous form has to first be dispersed and then reformed into a continuous thin strand or skein, in order to prevent the burning tobacco from crumbling when the cigarette is smoked.

Manual cigarette filling devices are known, for example U.S. Pat. No. 3,509,887, in which the tobacco supply is first corrected by hand and then the amount needed for one cigarette inserted in an elongated forming device. Subsequently, a contact pressure dish is pressed onto the preformed tobacco strand and the tobacco pressed together to form a round tobacco strand. By means of a manual lever device the preformed tobacco strand is then pressed into a cigarette paper shell which is positioned on a mounting device and held by a contact pressure device.

However, in order to form a continuous tobacco strand in these devices, it is necessary to exactly portion the amount of tobacco supplied to the device and to manually preform the tobacco fibers in a continuous fashion. When an insufficient amount of tobacco is supplied or when the tobacco fibers of the strand are not continuous, it often happens that the burning cigarette tip falls off partially or wholly during smoking.

The resulting fire hazards and annoyances created by extinction of a cigarette are well known and will therefore not be discussed. An additional disadvantage of the known devices consists in the fact that in order to manufacture cigarettes, several manual processes have to be carried out, which makes the manufacture of a larger number, for example the daily need of a smoker of optimally filled cigarettes complicated and difficult.

It is therefore the object of this invention to avoid the aforementioned disadvantages of known devices and to produce an apparatus for filling tobacco into premanufactured cigarette paper shells, which avoid manual portioning and dispersion of the tobacco to be used and which allows a continuous, firmly connected strand of tobacco to be formed and inserted into the cigarette paper shell.

This object is accomplished by providing a funnel-shaped tobacco hopper, a tobacco dispersion and dispensing device at its lower aperture with an essentially funnel-shaped tobacco supply chamber beneath the tobacco dispersion device, in the bottom of which a tobacco strand forming device of the transport spindle type is located, having a lateral outlet for the formed tobacco strand and with a cigarette shell-receiving or filling tube arranged laterally to the tobacco strand outlet.

One of the advantages of the invention is the fact that tobacco can be transferred to the hopper from a bag or a box virtually without manual pre-treatment, being automatically dispersed in the apparatus and fed to a tobacco strand forming device in which a firmly coherent tobacco strand is formed and automatically pushed into a cigarette paper shell.

The drive of the apparatus preferably consists of a single :aotor so that following the filling of the tobacco and the starting of the motor, an optimally filled cigarette, ready to be smoked, is eJected. Additional advantageous embodiments of the invention provide for the automatic sequential manufacture of large numbers of cigarettes.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof will be best understood from the following description of specific embodiments when read in connection with the accompanying drawings.

BRIEF DESCRIPTION OF THE DRAWINGS

FIG. 11 is a view of the dispersing and dispensing shaft.

FIG. 12 is a view of the dispersing and dispensing shaft taken along the line 12—12 in FIG. 11.

FIG. 13 is a view of a two-part conveyor spring.

FIG. 14 is a view of a modified filling tube.

FIG. 15 is a view of the filling tube taken along the line 15—15 in FIG. 14.

FIG. 16 is a view of a cigarette shell template.

DESCRIPTION OF THE PREFERRED EMBODIMENTS

Figure 1:
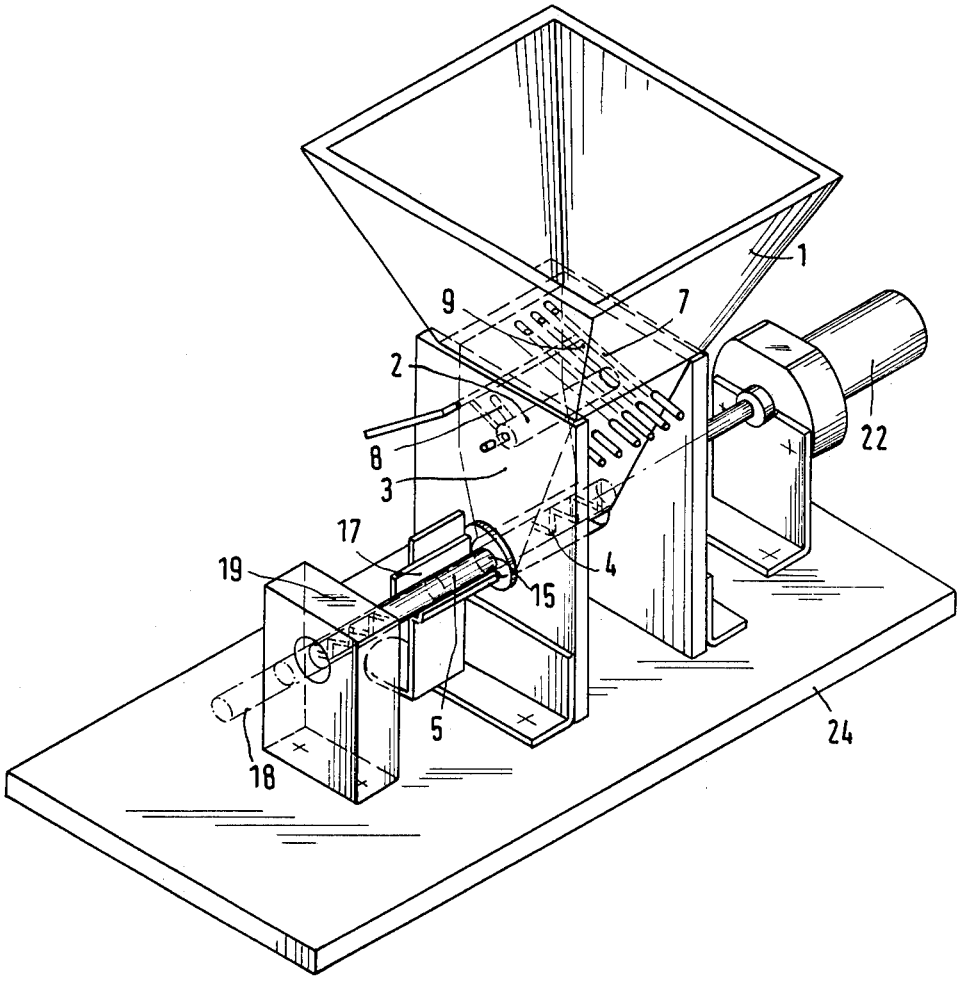
FIG. 1 is a perspective view of an apparatus for filling tobacco into cigarette shells according to one embodiment of the invention.
Figure 3:
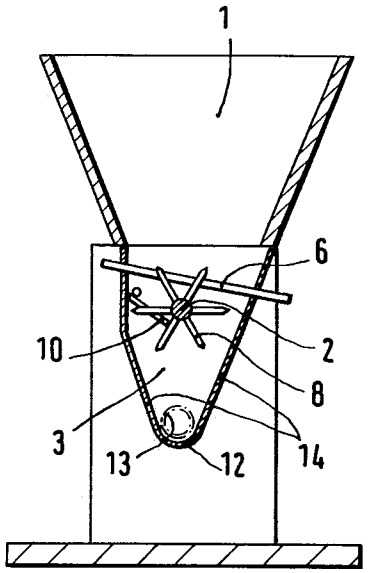
FIG. 3 is a view of the apparatus of FIG. 1 taken along the line 3—3 in FIG. 2.
Figure 2:
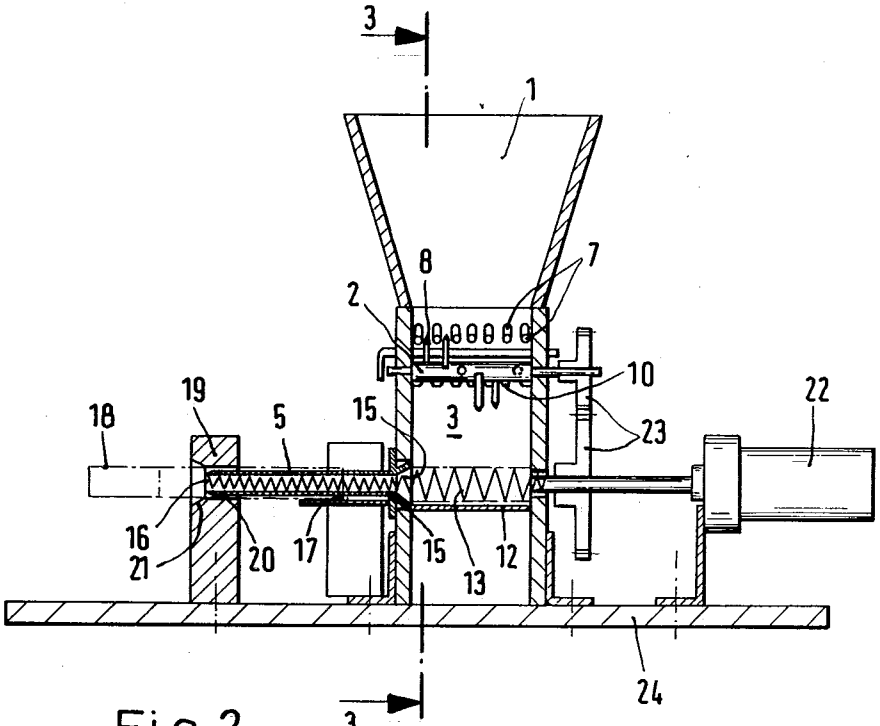
FIG. 2 is a view of the apparatus of FIG. 1 in longitudinal section.

The apparatus illustrated in FIGS. 1, 2 and 3 for the filling of tobacco into filter-cigarette paper shells has for clarity's sake been shown without an outer housing, with only the parts which are essential for the understanding of the invention having been shown.

The invention mainly consists of a funnel-shaped supply or filling hopper 1, a pin shaft 2, a tobacco supply chamber 3, a tobacco strand forming device 4, and a filling tube 5.

A rod grate 6 is provided in the outlet area between the filling hopper 1 and the tobacco chamber 3 and is formed by individual rods 7 separated from one another. A pin shaft 2 is arranged underneath the rod grate 6 so that pins 8, upon rotation of the pin shaft, successively pass through the spaces 9 of the rod grate, grasp the tobacco in the filling hopper 1, transporting it through the slits in the grate into the tobacco supply chamber 3. During this process the tobacco, which is in continuous form, is separated so that subsequently there is an amount of tobacco of fine-fibered structure in the tobacco supply chamber 3.

Next to the pin shaft 2, a stripping knife 10 is arranged in the tobacco supply chamber 3, having wedge-shaped slits 11 through which the pins 8 of the pin shaft are moved when rotating, stripping off tobacco fibers hanging from the pins 8. Tobacco fibers, which were previously transported into the tobacco supply chamber 3, are thus not conveyed back to the supply hopper 1. On the bottom of tobacco supply chamber 3, which is formed as a funnel tapering in a downward direction, the tobacco strand forming device 4 is disposed and consists essentially of a half-shell trough 12 and the therein rotatably mounted conveyor spring 13. Trough 12 and the funnel walls 14 can be formed from a one-piece metal material. Trough 12 is disposed closely adjacent to conveyor spring 13, and the conveyor spring 13 rotates in the trough 12 which is open on the top.

The tobacco supply chamber 3 has a lateral outlet 15 in its lower area, in the extension of the tobacco strand forming device 4, with the filling tube 5 being attached to the outlet. The end of the conveyor transport spring 13 projects into the filling tube 5 and terminates with its front edge 16. On the wall-side end of the filling tube 5, a contact pressure device 17 is provided for the cigarette paper shell 18, overlapping approximately $\frac{1}{3}$ of the cigarette shell pushed onto and disposed on the filling tube 5.

Furthermore, a cigarette paper shell forming device 16, adjacent to the end 19 of the filling tube consists essentially of a form piece with a cylindrical bore 20 and a conical supply opening 21, with the bore diameter corresponding to the outer diameter of the cigarette paper shell. By means of this forming device, the cigarette paper shells, which are to be pushed onto the filling tube, which are often slightly deformed, i.e., not round but oval because of the thinness of the material, can be brought into a precise, round form, so that they can be pushed onto the filling tube without effort or difficulty.

Pin shaft 2 and transport spring 13 are preferably driven by motor 22, with the pin shaft 2 being driven through a gear train 23 at a turning speed which is preferably approximately 1.8 to 2 times greater than the turning speed of the conveyor spring 13. In any case, the two speeds are coordinated with each other so that a sufficiency of tobacco is emptied into the supply chamber to be seized by the conveyor spring, formed into a strand or skein and conveyed or pushed into the cigarette shell.

When the device is started, a small quantity of tobacco can be placed in the tobacco supply chamber 3 in order to insure that there is sufficient tobacco to continuously form the tobacco strand or skein without interruption as the first filling operation begins.

The individual components of the cigarette filling device are mounted on a common base plate 24 in the illustrated embodiment. This arrangement should only be seen as an example of one embodiment. Variations, within the framework of the invention, are possible but will not be discussed further here.

Figure 4:
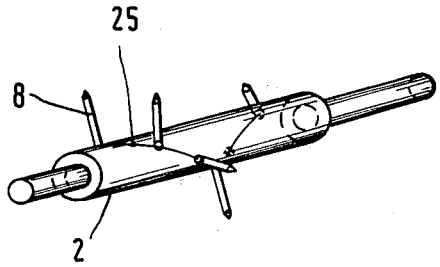
FIG. 4 is a view of the pin shaft.
Figure 5:
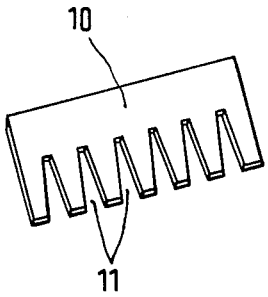
FIG. 5 is a perspective view of the stripping knife.

The pin shaft 2 shown in FIG. 4 essentially consists of a round shaft into which the pins 8 are mounted along a spiral path 25 so that with rotation of the pin shaft, only one pin of the shaft is located between the rods 7 of the rod grate 6, or in the respective slit 11 of the stripping blade 10. Thus, a uniform seizing and dispersion of the tobacco can be accomplished with low power required to drive the pin shaft.

Figure 6:
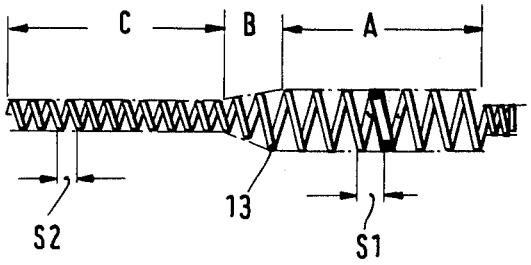
FIG. 6 is a view of the conveyor spring.

In FIG. 6, the conveyor spring 13 is illustrated with enlargement. Its features, which are essential for forming a continuous tobacco skein, will be subsequently explained. The conveyor spring 13 is preferably made of a sharp-edged 4-edge material and has three main sections, A, B, and C.

Section "A" is cylindrical and has a diameter of approximately 10 mm. This section, when the conveyor spring is inserted into the device, is disposed in the semicircular trough 12 and it first seizes the tobacco when the spring is rotated. The pitch $S_1$ of the spring coils in this section is approximately 5 mm. As a result the tobacco fibers can easily pass through the coils to the interior of the conveyor spring. The relatively coarse pitch and large diameter prevent the formation of a hollow space between the upper side of the conveyor spring and the tobacco supply above it.

Section "B" forms the inlet zone into the filling tube 5. Here, the spring diameter smoothly decreases from 10 mm to approximately 5 mm. The length of this section is around 10 mm. By this narrowing and the rotation of the conveyor spring, the tobacco fibers, in association with the filling tube geometry of this area (conical-oval) are combined into a continuous strand or skein in this section and compressed in diameter.

Section "C" is the section provided for the interior of the cylindrical part of the filling tube. The spring diameter is smaller here than in Section A, in the present example approximately 5 mm. The pitch $S_2$ of the spring coils is also finer here, only 3 mm. The result thus achieved is that the tobacco strand, only loosely formed in Section A and reduced in diameter in Section B, is compressed longitudinally as well, so that a firm, continuous tobacco strand is formed. It should also be mentioned that in this embodiment the inner diameter of the filling tube is approximately 7 mm, i.e., there is an air space of approximately 1 mm on all sides.

It should be mentioned in connection with the above measurements that these relate to an embodiment in which cigarette papers are used, which have a diameter of approximately 8 mm. However, the invention is not so limited, but can be used, while maintaining the basic principle, for other shell diameters as well, with the indicated measurements merely having to be adjusted to other dimensions.

Figure 7:
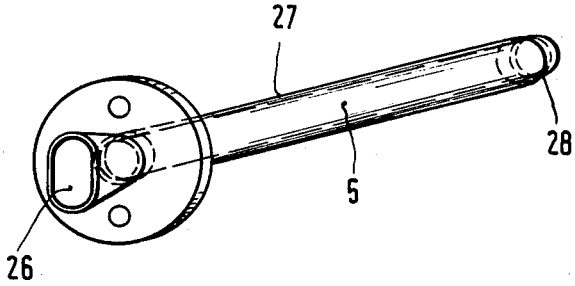
FIG. 7 is a view of the filing tube.

The filling tube 5 shown in FIG. 7 consists of a thin-walled material, for example stainless steel, brass, bronze or plastic. The inlet 26 is conical-oval, while the body 27 is cylindrical.

The end 28 is conical-round. With the conical-oval shape of the inlet, an uninterrupted supply of the tobacco strand into the filling tube is made possible. The slightly conical end area 28 permits easy sliding or pushing of the cigarette shell onto the filling tube itself. Furthermore, the conical shape of the end results in additional compression of the exiting tobacco strand in the interior of the filling tube as well, with an optimal flow and uniform feeding of the tobacco skein.

The filling of a cigarette paper shell, i.e., the operation of the device for filling cigarette tobacco into cigarette papers, will be explained below. Initially, the cigarette tobacco, which is to be processed, is transferred from a bag or supply box into filling hopper 1. It is not necessary to crumble or pull the tobacco apart into individual fibers, but, within certain limits, continuous hanks can be filled as well. Subsequently, a filter cigarette paper shell 18 is completely pushed or slid onto the filling tube 5. By the paper shell forming device 19, through which the cigarette shells are pushed, oval cigarette shells are formed into a precise, round shape, so that they can be easily slid over the filling tube. A contact pressure device 17 presses, when the cigarette paper shell is in its end position, a front section of approximately ⅓ of the cigarette paper shell length against the filling tube and clamps the shell into position. By means of a non-illustrated adjustment device, this pressure can be adjusted, in order to individually adjust the stuffing firmness of the cigarette, which depends on the quality of the tobacco (structure, moisture, etc.). Then the drive 22 is turned on. This can be done automatically by suitable tracer or sensor devices when the cigarette paper shell is fully in place and clamped, or by hand by a push button switch or similar device.

With the starting of the motor 22, the pin shaft 2 rotates, as does conveyor spring 13. By the rotating pin shaft, the tobacco present in the supply container is seized and conveyed to the tobacco supply chamber 3 through the rod grate 6. The tobacco is finely dispersed reaching the supply chamber in the form of individual fibers.

The tobacco fibers fall onto or into the conveyor spring and are seized by this and brought into its inner space. The use of 4-edged material or wire for the conveyor spring has proved particularly advantageous, since the tobacco fibers can be more easily seized and transported than by transport springs made of round wire.

By the pitch of the conveyor spring coils, the tobacco fibers are twisted together in the inner space of the spring and transported from Section A with a larger spring diameter into Section C with a smaller spring diameter. As previously explained, the tobacco is compressed and a firm, continuous tobacco strand formed. As soon as the tobacco strand exits the filling tube, the end 28 thereof is once more compressed by the conical shape of the filling tube at this point, the tobacco strand presses against the filter end of the cigarette paper shell. The tobacco presses into the cigarette shell as the tobacco continues to emerge from the filling tube and pushes the shell forward and off the filling tube. By the pressure of pressure device 17, the tobacco in the first third of the filling area is firmly pushed into the cigarette paper shell. During the remaining filling procedure (i.e., remaining ⅔), the special pressure of the cigarette paper shell on the filling tube is no longer required, since it has been shown that the firmness of the tobacco strand still emerging is sufficient for the firm filling of the cigarette to remain satisfactory without additional meausures. The described arrangement of the contact pressure device has been shown to be particularly advantageous for arriving at a uniform filling of the cigarette shell.

During continued filling of the cigarette paper shell, the shell is eventually pushed off the filling tube until finally the completely filled cigarette paper shell can be removed from the filling tube end. By suitable tracer or sensor devices, which have not been illustrated in detail, this moment can be registered and the drive switched off. Subsequently, a new cigarette paper shell can be pushed over the filling tube and filled in the same manner.

Figure 8:
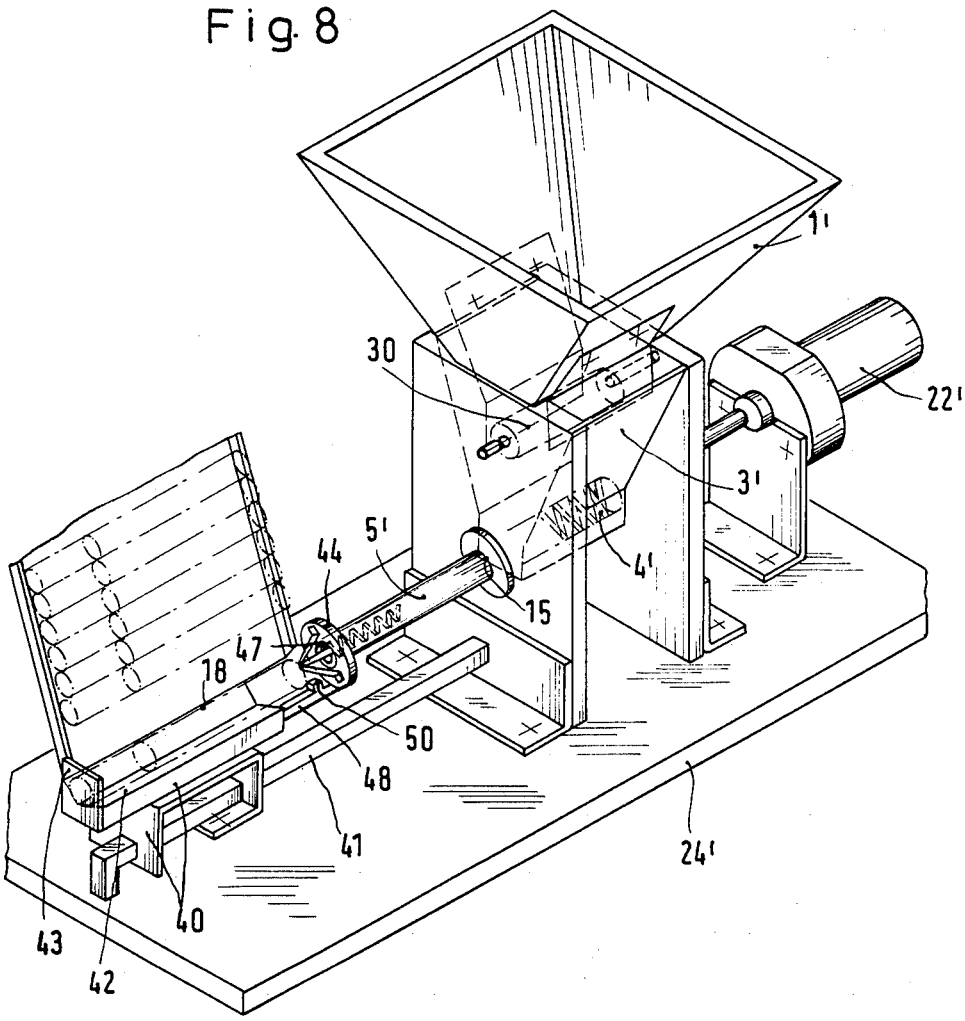
FIG. 8 is a perspective view of a modified apparatus for filling tobacco into cigarette paper shells.
Figure 10:
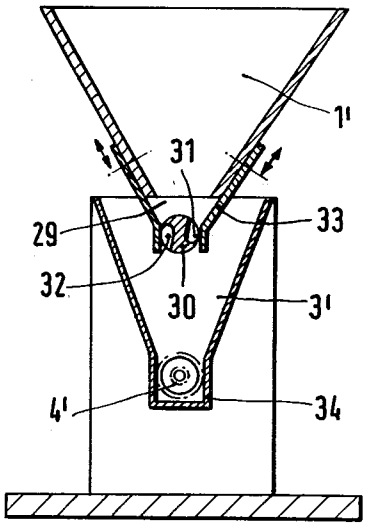
FIG. 10 is a view of the apparatus of FIG. 8 taken along the line 10—10 in FIG. 9.
Figure 9:
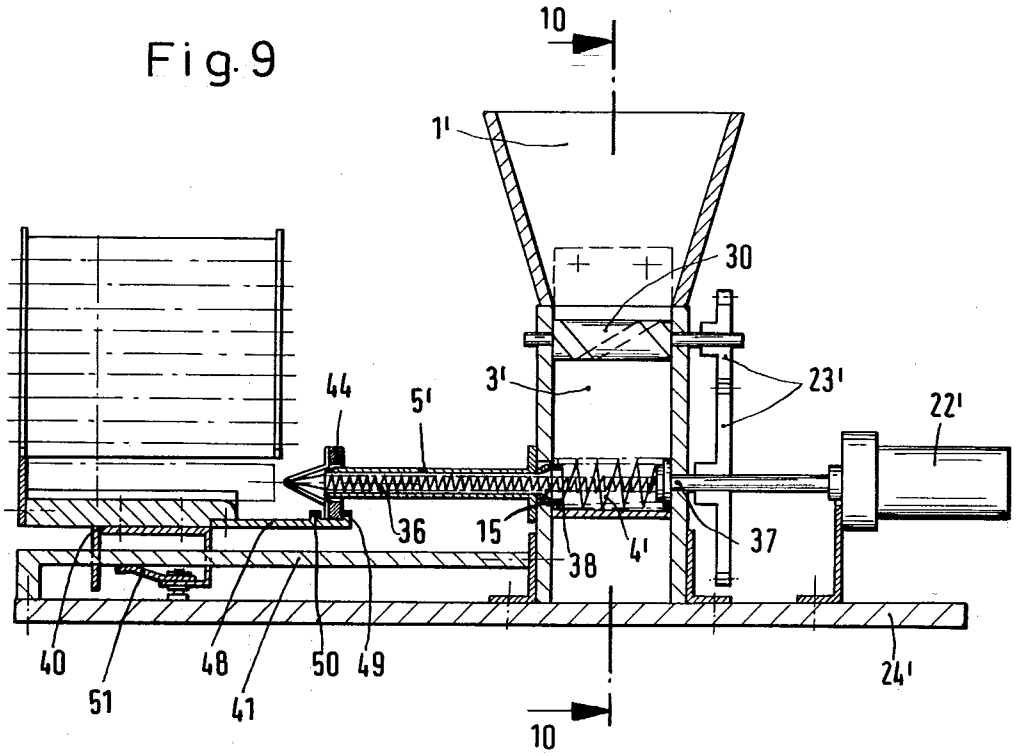
FIG. 9 is a view of the apparatus of FIG. 8 in longitudinal section.

FIGS. 8, 9, 10 illustrate a device for filling cigarette tobacco into cigarette shells in modified form, which will be explained below. This device essentially consists of the funnel-shaped supply of filling hopper 1', a tobacco supply chamber 3', a tobacco strand forming device 4' and a filling tube 5'.

In a passage 29 between the hopper 1' and the tobacco supply chamber 3', a knife shaft 30 is provided. The shaft has spirally arranged cutting edges 31, as well as molded tobacco-reception recesses 32 in the rotating direction of the shaft in front of the cutting edges. The side walls 33 of the lower end of the filling container in the area of the knife shaft are adjustably mounted on the upper funnel wall so that the space between the knife shaft and the side wall can be adjusted.

The tobacco supply chamber 3' has a rectangular, longitudinal space 34 in its lower area, which is open on the upper side and in which the tobacco strand forming device 4' is located.

The tobacco strand forming device consists essentially of a two-part spring arrangement (see also FIG. 13), with an outer cylindrical spring 35 with large diameter and coarse pitch of the coils in the interior of which an inner cylindrical spring 36 with small diameter and finer pitch of the coils as well is located. The inner diameter of the outer spring approximately corresponds to the width of space 34 in which the spring is rotatably arranged, and the length of the spring corresponds to the length of the space, i.e., the width of the tobacco supply chamber. The inner spring 36 intersects the outer spring in its entire length and projects from it on the filling tube side. The total length of the inner spring is determined so that it corresponds with the front edge of the filling tube 5' when the device is assembled. The diameter of this inner spring corresponds to the inner diameter of the filling tube so that it can be rotated in the filling tube with slight lateral working action.

The springs 35 as well as the springs 36 are made of sharp-edged, 4-edge material, with the cross-section of the spring material of the larger spring being preferably larger than the cross-section of the spring material of the smaller spring. For example the outer spring 35 may be made of square spring wire of a cross-section of approximately 1.3 mm square and the inner spring 36 may be made of square spring wire with a cross-section of approximately 1 mm square.

Both springs are pressed onto lugs on the drive shaft 37, matching their diameters, and fastened. On the opposite end it can be provided that the larger spring is rotatably mounted on a corresponding lug 38. Conveyor springs 35, 36 and the dispensing shaft 30 are driven by a common drive device (for example, motor 22') through a gear train 23' in this embodiment as well.

As can be seen from FIGS. 14 and 15, the filling tube has a tapered inlet area 26' as well, which, however, in this embodiment is preferably rectangular and continuously joins the round, cylindrical part of the filling tube. Furthermore, the filling tube has longitudinal grooves 39 in its interior.

As mentioned above, the transport spring diameter of the part of the conveyor spring extending into the filling tube is such that the transport spring can be rotated in the filling tube with lateral play. The grooves 39 in the interior wall of the filling tube serve to improve the flow behavior of the tobacco strand being conveyed. A slight conical beveling 28' of the filling tube end facilitates the sliding of the cigarette paper shells onto the filling tube.

In the embodiment according to FIG. 8, a carriage 40 is provided which is arranged in a longitudinally movable fashion on a slide bar 41. The carriage has a receptacle 42 with an end contact point 43 for the cigarette paper shells, in which the cigarette paper shell is guided so that its axis is aligned with the axis of the filling tube. The movement of the carriage in the direction of the filling tube, for the purpose of sliding the cigarette paper shell onto the filling tube is done either by hand or by a motor drive which has not been illustrated in detail.

Furthermore, filling tube 5' has an essentially movable forming and centering part 44, which has been illustrated as an individual part in FIG. 16 and essentially consists of a ring-shaped guide sleeve 45 with the opening 46 being of a size so that the sleeve can be easily pushed onto the filling tube. Thin, elastic tongues 47 are mounted on the sleeve, which in the initial position of the forming and centering part (with the part 44 pushed all the way forward, the shell is still on the filling tube) spring together in a conical point in front of the filling tube. A driving arrangement 48 for the forcible movement of the forming and centering part is mechanically coupled to the carriage 40 and has spaced projections 49 and 50.

When the cigarette paper shell 18 slides onto the filling tube, the carriage 40 with the cigarette paper shell is moved towards the filling tube. The point formed by the elastic tongues of the forming and centering part dips into the cigarette paper shell opening and the projection 50 of the drive arrangement is attached to the sleeve of the forming and centering part. During the continued sliding, the cigarette paper shell and the forming and centering part are simultaneously moved to the right (as seen in FIGS. 8, 9). With continued sliding of the forming and centering part onto the filling tube, the elastic tongues 47 open outwardly by the penetration of the filling tube, and press the cigarette paper shell opening, into which they dip, as already explained, into a precise, round form. With further movement of the carriage, the cigarette paper shell is slid onto the filling tube and the forming and centering part pushed onto the right end position as well. The ends of the elastic tongues are located in the front portion of the cigarette paper shell, between the shell and the filling tube. The elastic tongue ends are extremely thin and their shape is adjusted to the rounding of the cigarette paper shell or the filling tube. In order to avoid an excessive expansion and possible tearing of the paper shell, the filling tube can have deepened outer longitudinal grooves into which the tongue ends dip when sliding onto the filling tube.

When the cigarette shell has slid completely over the filling tube, the drive of the tobacco strand forming device 4' is switched on and the tobacco strand exiting the filling tube enters the cigarette paper shell. With continued filling of the cigarette paper shell, the shell is eventually slid off the filling tube with the carriage 40 beihg pushed at the same time. When contact point 49 touches shell 44, the forming and centering part is moved in the direction of the end of the filling tube as well. The carriage is provided with an adjustable spring brake 51 which works on the slide bar with the adjustable brake power making it possible to individually adjust the firmness of the tobacco filled into the cigarette paper shell.

As soon as the cigarette paper shell has been completely filled and completely slid off the filling tube, the drive of the tobacco strand forming device is switched off and within a short time reversed to be driven in the opposite direction. By the reverse rotation of the conveyor spring 36, the tobacco strand is twisted off at the filling tube end and separated from the cigarette filling. It has been shown that a minimal or slight projection of the conveyor spring 36 past the filling tube end improves the separation of the tobacco strand. A cigarette, ready to be smoked, is the result and the front end of the cigarette is then tapped by a magnetically operated tapping device, in order to knock any projecting tobacco fibers into place. After the cigarette has been removed from the guide carriage 40, an empty cigarette paper shell can be placed onto the carriage to be filled in the same manner.

Although the feeding of empty cigarette paper shells and the removal of finished cigarettes can be manual, it is mentioned for the sake of completeness, that a supply device for the automatic feeding of cigarette paper shells from a supply on the transport carriage can be provided, as well as automatic removal of finished cigarettes from the carriage in a collection container, with the drive of these supply and removal devices being in the form of a drive connection from drive motor 22, 22' or by means of a separate motor and with the individual processes being controlled by registering the various operating conditions by suitable tracer or sensor devices (microswitches, photosensors, etc.) and with electrical linkage and guidance.

What is claimed is:

1. Apparatus for manufacturing cigarettes, comprising a tobacco hopper having a lower aperture, dispensing means receiving tobacco from said aperture and dispersing said tobacco, said dispensing means comprising a rotatable knife shaft disposed in said aperture of said hopper, a tobacco supply chamber disposed below said hopper to receive tobacco from said dispensing means, conveyor means in said tobacco supply chamber for forming tobacco into a strand, an outlet on said tobacco supply chamber for the lateral discharge of the said strand of tobacco, and a cigarette paper shell filling tube disposed adjacent to said outlet to receive therefrom said strand of tobacco to thereby form a cigarette.

2. Apparatus according to claim 1 in which said knife shaft has a plurality of cutting edges.

3. Apparatus according to claim 2 in which said cutting edges are arranged in a spiral.

4. Apparatus according to claim 2 in which said cutting edges, as seen along the knife shaft, are formed by curved longitudinal grooves.

5. Apparatus according to claim 1 further comprising means for adjusting the width of said aperture.

6. Apparatus according to claim 1 in which a cigarette shell forming device containing a hollow shaping and centering device provided with a feeder opening is disposed at the end of said filling tube and in line therewith for the insertion of said tobacco strand into said cigarette shell.

7. Apparatus for manufacturing cigarettes, comprising a tobacco hopper having a lower aperture, dispensing means receiving tobacco from said aperture and dispersing said tobacco, a tobacco supply chamber disposed below said hopper to receive tobacco from said dispensing means, conveyor means in said tobacco supply chamber for forming tobacco into a strand, an outlet on said tobacco supply chamber for the lateral discharge of the said strand of tobacco, a cigarette paper shell filling tube disposed adjacent to said outlet to receive therefrom said strand of tobacco to thereby form a cigarette, and a cigarette paper shell forming device containing a hollow slidably shaping and centering device provided with a feeder opening disposed at the end of said filling tube and in line therewith for the insertion of said tobacco strand into said cigarette paper shell, said slidable shaping and centering device consisting of a sleeve slidable over said filling tube and equipped with an annular arrangement of spring tongues pointing along the sleeve axis with the ends of said tongues converging to a location in front of the end of said filling tube when said shell forming device is not yet fully engaged with said filling tube.

8. Apparatus according to claim 7 in which said filling tube is equipped with a contact pressure means.

9. Apparatus according to claim 8 further comprising means for adjusting the contact pressure of said contact pressure mean.

10. Apparatus for manufacturing cigarettes, comprising a tobacco hopper having a lower aperture, dispensing means receiving tobacco from said aperture and dispersing said tobacco, a tobacco supply chamber disposed below said hopper to receive tobacco from said dispensing means, conveyor means in said tobacco supply chamber for forming tobacco into a strand, said conveyor means for forming a tobacco strand and said dispensing means being driven through a gear train by a single drive element, an outlet on said tobacco supply chamber for the lateral discharge of the said strand of tobacco, and a cigarette paper shell filling tube disposed adjacent to said outlet to receive therefrom said strand of tobacco to thereby form a cigarette.

11. Apparatus for manufacturing cigarettes, comprising a tobacco hopper having a lower aperture, dispensing means receiving tobacco from said aperture and dispersing said tobacco, a tobacco supply chamber disposed below said hopper to receive tobacco from said dispensing means, conveyor means in said tobacco supply chamber for forming tobacco into a strand, an outlet on said tobacco supply chamber for the lateral discharge of the said strand of tobacco, a cigarette paper shell filling tube disposed adjacent to said outlet to receive therefrom said strand of tobacco to thereby form a cigarette, and a cigarette paper shell forming device containing a hollow shaping and centering device provided with a feeder opening disposed at the end of said filling tube and in line therewith for the insertion of said tobacco strand into said cigarette paper shell, said cigarette shells being supplied and cigarettes removed from said filling tube by means of a sliding carriage.

12. Apparatus according to claim 11 in which said cigarette shell supporting element contains a recess with rounded contours.

13. Apparatus according to claim 12 in which said recess is slitted at its bottom.

14. Apparatus according to claim 11 in which the cigarette shells are supported by two arms forming a trough.

15. Apparatus according to claim 11 in which the cigarette shells are fed automatically to said sliding carriage and the filled cigarettes, after removal from said filling tube, are tapped at their ends to reinsert any loose projecting tobacco fibers.

* * * * *